United States Patent [19]

Stobb

[11] 4,361,318

[45] Nov. 30, 1982

[54] APPARATUS AND METHOD FOR CONTROLLING SHEET STACKER SPEED

[75] Inventor: Walter J. Stobb, Pittstown, N.J.

[73] Assignee: Stobb, Inc., Clinton, N.J.

[21] Appl. No.: 55,504

[22] Filed: Jul. 9, 1979

[51] Int. Cl.[3] ..... B65H 29/14; B65H 31/06

[52] U.S. Cl. ..... 271/202; 198/571; 271/214; 271/215; 271/199

[58] Field of Search ..... 271/202, 203, 185, 178, 271/214, 215, 216, 176, 263, 262, 217, 199, 69, 270; 414/105, 107, 98, 100, 900; 198/571, 572

[56] References Cited

U.S. PATENT DOCUMENTS

| | | | |
|---|---|---|---|
| 2,884,243 | 4/1959 | Stobb | 271/178 |
| 2,933,313 | 4/1960 | Stobb | 271/202 X |
| 2,933,314 | 4/1960 | Stobb | 271/215 |
| 3,719,267 | 3/1973 | Reist et al. | 271/202 X |
| 3,826,487 | 7/1974 | Forster et al. | 271/263 |
| 3,842,719 | 10/1974 | Fernandez-Rana et al. | 271/216 X |
| 3,880,420 | 4/1975 | Martin | 271/202 X |

*Primary Examiner*—Bruce H. Stoner, Jr.
*Attorney, Agent, or Firm*—Arthur J. Hansmann

[57] ABSTRACT

Apparatus and method for controlling the speed of the conveyor on which a stack of sheets is being collected. A first conveyor moves a stream of sheets into a stacker and onto a second conveyor which moves the stack away from the incoming stream. The stream is moved around a drum which forms a part of the first conveyor and a second conveyor receives the stack and moves at a speed which accommodates the growth of the stack. A sensor detects the thickness of the stream of sheets, and another sensor detects the speed of the first conveyor, and the two sensings are transmitted to the drive for the second conveyor so that the second conveyor is moved at an automatic and appropriate speed to accommodate the incoming stream of sheets.

8 Claims, 2 Drawing Figures

23
24
37
36
S
A
27
31
28
32
33
34
29
39
11
38
56
18
17
61
62
SS
21
19
22
43
47
41
44
52
T
SS
13
51
46
49
48
10
16
14
12
26

APPARATUS AND METHOD FOR CONTROLLING SHEET STACKER SPEED

This invention relates to apparatus and method for controlling the speed of a conveyor on which a stack of sheets is being formed, and, as such, it pertains to the control of the stack conveyor employed in a sheet stacker utilized in the printing industry.

BACKGROUND OF THE INVENTION

Sheet stackers which collect sheets of paper, such as those produced by a printing press and a cutter and a folder assembly, are commonly employed in the prior art in the printing industry. In those prior art stackers, a stream of sheets is collected on a first conveyor which receives the sheets from a folder or the like and which moves the sheets to a stacker or in a stacked relation and on a second conveyor. In this arrangement, the stream of sheets is stripped off the first conveyor and collected in the stack on the second conveyor in an upstanding position. In that arrangement, it is important that the conveyor supporting the stack of sheets move at a critical speed which accommodates the growth of the stack. That speed depends upon the speed of the stream of sheets coming into the stack and also upon the thickness of the stream of sheets, both factors which bear upon the rate of growth of the stack itself. That is, if the stream of sheets is moving relatively fast, then of course the stack will be formed relatively fast; and if the stream of sheets is relatively thick, then the sheets which are stood on edge in the collected stack will cause the stack to be formed relatively fast also.

In summary, the prior art stackers have the two variables of the speed and thickness of the incoming stream of sheets, and those variables determine the rate of growth of the collected stack of sheets. The prior art has accommodated these variables by a manual speed control for the conveyor on which the stack of sheets is being collected and formed. Such manual control can commonly consist of adjusting the pitch of a pulley which forms a part of the conveyor for the collected stack of sheets. However, in that prior art arrangement, it requires that the operator constantly monitor the stacker so that he can make the necessary manual adjustments to get the best speed for the conveyor on which the stack is being formed. One prior art example of that type of manual control is shown in U.S. Pat. No. 2,933,313 wherein the relative speed between two conveyors supporting a stream of sheets is controlled by the manual means of varying the effective pitch of pulleys which are operatively associated with the said two conveyors. The prior art cited also discloses a stack conveyor speed control which relies upon the expansion and contraction of one of the conveyor pulleys or rollers on which the conveyor belt is trained, all to manually adjust the speed of the stack conveyor belt.

For further background and expose of the prior art in stackers of the nature of this invention, reference is made to U.S. Pat. No. 2,884,243 wherein there is a first conveyor for supporting the stream of sheets and a second conveyor for supporting the stack of sheets received from the stream and moving the stack away from the stream. In both instances of the cited prior art, the present invention distinguishes thereover in that it provides an automatic system and method for controlling the speed of the stack conveyor, and that control is made in accordance with the speed and thickness of the incoming stream of sheets, and those two factors can be and generally are variable, and thus there is an automatic method for sensing those two variables and driving the stack conveyor in accordance with those variables so that the stack moves at the appropriate rate of speed.

Other features and advantages and improvements upon the prior art will be apparent to one skilled in the art on reading the following description in light of the accompanying drawings.

DETAILED DESCRIPTION OF THE PREFERRED EMBODIMENT

Figure 1:
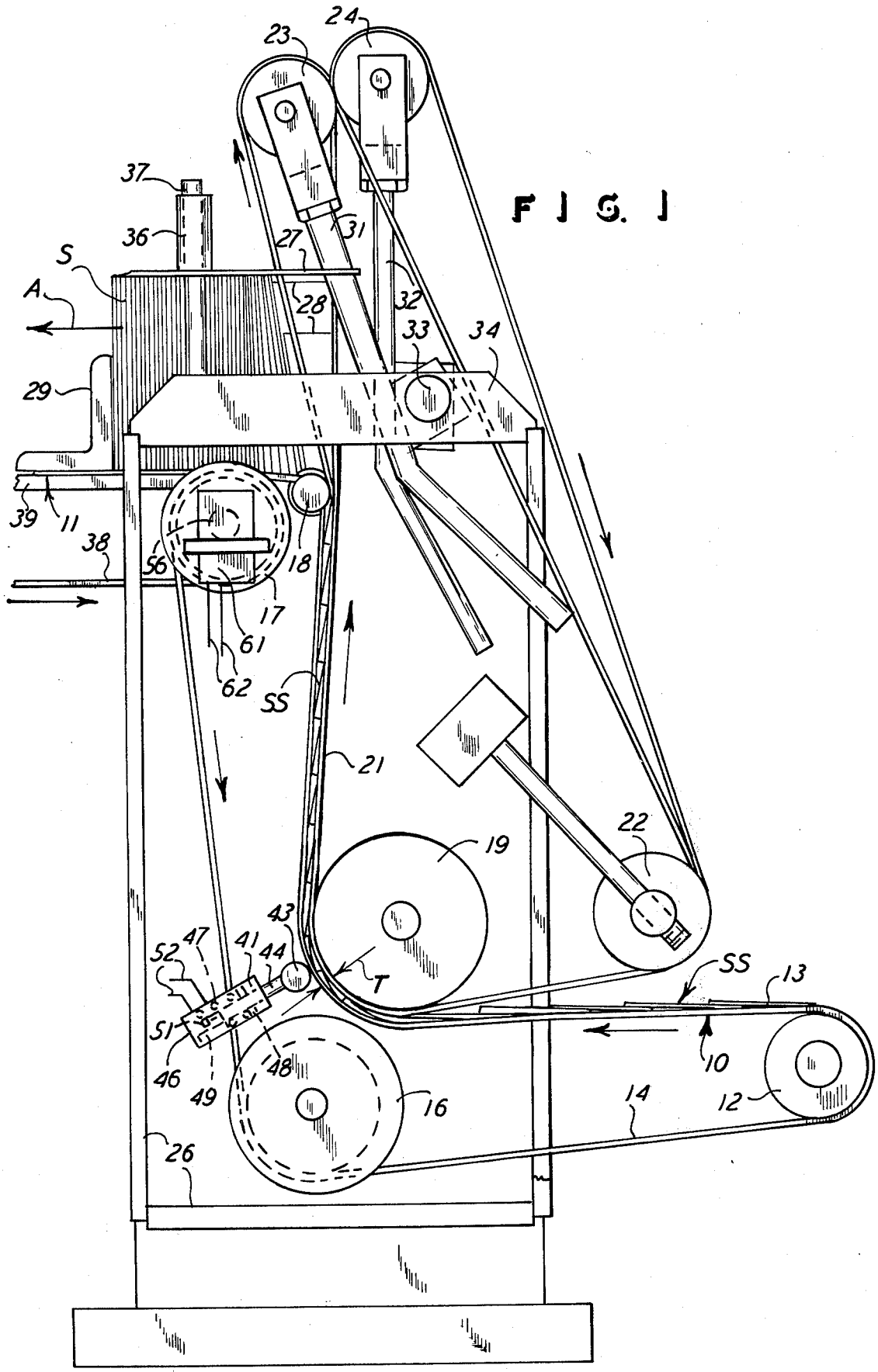
FIG. 1 is a side elevational view of a stacker having the speed control apparatus of this invention.

Reference is again made to U.S. Pat. No. 2,933,313, and the teaching thereof is incorporated herein by reference, to the extent that it discloses a manually operative arrangement for altering the speed of the stack conveyor so that the stack will move or grow at a rate relative to the rate of the stream of incoming sheets. That rate of course depends upon the linear speed and thickness of the incoming stream of sheets. For further disclosure of this invention, and in addition to the disclosures herein which enable anyone skilled in the art to understand and construct apparatus of this invention, the accompanying drawings are submitted. The drawings show a sheet type of stacker which has a first or incoming conveyor generally designated 10 and a second or stack conveyor generally designated 11 and on which the stack S is formed and accumulated. Therefore, in the usual and well-understood manner by anyone skilled in the art, a stream of sheets SS is accumulated on the first conveyor 10 which has its rotatably mounted pulley 12 disposed adjacent to a sheet folder or the like so that the sheets 13 can fall onto the conveyor 10 in the imbricated or shingled form as shown. That is, the conveyor then has an endless conveyor belt 14 which extends around the pulley or roller 12 and also around the pulleys or rollers 16, 17, and 18, and also around the rotatable cylinder or drum 19. Thus the conveyor 10 supports the stream SS and moves in the direction of the arrows shown adjacent the conveyor belt 14, all to conduct the stream of sheets into the stack S. To further support the stream SS, the so-called first conveyor 10 has another conveyor belt or branch 21 which is trained over the rotatable pulleys 22, 23, and 24, as well as being trained over the rotatable cylinder or drum 19. Thus, in the upright extent of the first conveyor 10, and that is in the position immediately to the left of the drum 19 and extending thereabove to the stack S, the two conveyors or belts 14 and 21 contain the imbricated stream SS therebetween and support and move the stream of sheets into the stack S, all in a well-known manner, such as that shown and described in referenced U.S. Pat. No. 2,884,243.

To accomplish the aforementioned, the stacker includes the frame pieces 26 which provide support for the pulleys and the drum 19, except for the pulley 12, and the frame 26 also includes a stop member 27 at the upper edge of the stack S and that member 27 extends through the path of the conveyor branch 21 to thus engage the upper edges 28 of the sheets 13 in the incoming stream, and thus the sheets 13 are stripped off their stream relation and are accumulated in the aligned or stacked relation, such as shown by the stack S which therefore grows or moves in the direction of the arrow designated A. As will further be understood by one skilled in the art, a stack support or back member 29 is disposed at the stack left hand or leading end, as viewed in FIG. 1, to give the stack the upright and on-edge support for the disposition of the upstanding sheets 13 in the stack S, as shown. Still further, the pulleys 23 and 24 are adjustable toward and away from the stack S, so that those leading sheet edges 28 can be curved for stiffening when they abut the stop 27 and thus assure good alignment of the sheets in the stack S, and that also is an arrangement which is known to one skilled in the art and can be accomplished by means of movably mounting the pulleys 23 and 24 on their support arms 31 and 32, respectively, and having those two arms in turn pivotally supported on a shaft 33 in the stacker frame piece 34.

It is further common practice and well known that the stop 27 can be adjustable up and down, such as by means of the threaded sleeve 36 on a support rod 37 to have the sleeve 36 carry the stop 27 up and down in accordance with the height of the sheets 13 as they form in the stack S. Of course the stack S is formed on the second conveyor 11 which includes the pulley 17 and the conveyor belt 38 driven by the pulley 17 and driven in a manner more fully explained hereinafter. A support frame member or bed 39 extends under the upper extent of the belt 38, as shown in FIG. 1, to support the belt 38 and the stack S which is on the belt 38, all in the usual manner and as known by anyone skilled in the art.

Figure 2:
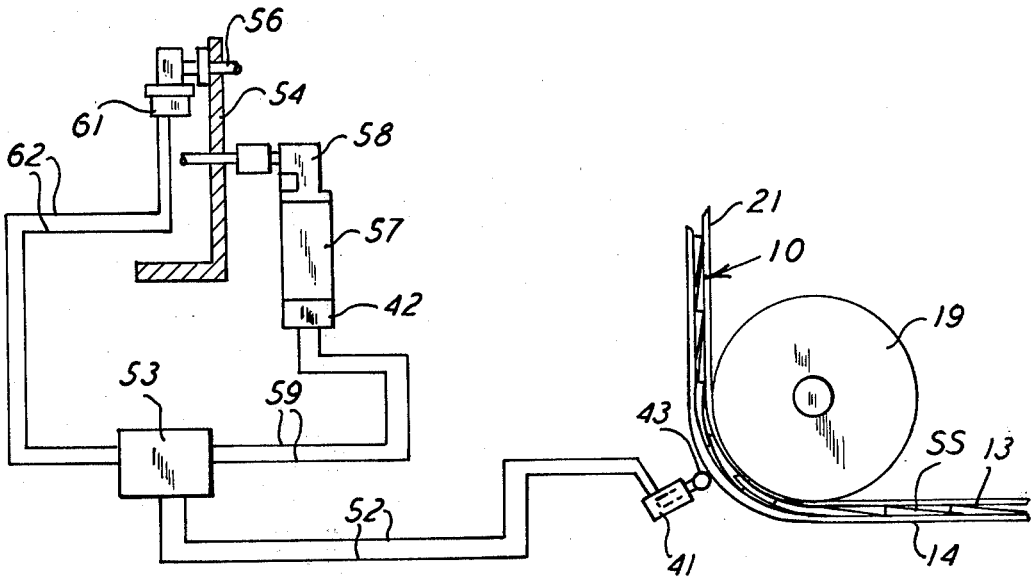
FIG. 2 is a schematic view of the speed control apparatus of this invention as related to a sheet stacker.

Beyond the aforementioned which is all prior art, the present invention relates to monitoring the incoming stream of sheets SS for both the linear speed and the thickness of that incoming stream, and those two factors determine the rate of growth of the stack S in the direction of the arrow A. To accomplish this, there is a first sensor 41 which detects changes in the thickness T in the stream SS, and there is a second sensor 42 which detects changes in the linear speed of the first conveyor 10, as shown in FIG. 2. Of course the stream SS is trained for approximately a quarter circle about the cylinder or drum 19 which is commonly employed in the prior art for this type of stacker, and the stream SS presents a certain thickness, either with or without considering the thickness of the conveyor belts 14 and 21 which are on opposite sides of the stream SS. Any changes in the stream thickness will be detected by the sensor 41 which is in the nature of a feeler gauge having a feeler or roller 43 in contact with the stream SS or the conveyor belt 14, as preferred. The change in the thickness of the stream SS will cause the feeler 43 to move radially relative to the axis of rotation of the drum 19, and that will therefore displace the support arm 44 which holds the feeler 43 and which extends into a sensor housing 46. A compression spring 47 is disposed in the housing 46 and bears against a pin 48 extending through the feeler arm 44 to thus urge the feeler 43 toward the drum 19 which is a support for the incoming stream SS.

Also, an electric element 49 is disposed in the housing 46 and has a pick-up arm 51 which creates an electric signal, in the nature of an electric bridge, upon movement of the support arm 44 as mentioned. That electric signal is transmitted through the electric wires 52 connected to the pick-up 51 and the electric base member 49 which form the rheostat type of bridge which is well known in the art. In that manner, any changes in the thickness of the incoming stream SS are detected by the sensor 41 and those changes create an electronic signal which is passed through the wires 52 and to an electronic control or transducer 53 electrically connected with the wires 52, as shown. Of course the transducer is of a conventional construction and will be well known by anyone skilled in the art, and it is simply of a nature which receives an electric signal and in turn passes the signal onto another electric element, all as explained hereinafter.

Thus the sensor 41 with its roller or feeler-type gauge 43 is spring-urged against the belt 14 or against the stream SS, by means of the spring 47, to determine the thickness T. Any detected variation in the thickness T by means of the sensor 41 will, in any conventional manner, create an electronic signal which is conducted through the wires 52 and to the electronic transducer 53.

FIG. 2 shows the stacker frame member 54 which suitably rotatably supports a driven shaft 56 on which the conveyor pulley 17 is mounted for supporting the conveyor belt 38 on which the stack S is located. Also, a main drive DC motor 57 is suitably mounted and is tachometer follower driven, through the gear reducer 58, for instance, from the drive of the printing press (not shown) or the like. Thus, the tachometer generator 42 which is electrically connected with the DC motor 57, will sense the speed of the motor 57 and thus create a suitable electric signal through the wires 59 connected between the generator 42 and the transducer 53 and thus the second electric signal is impressed upon the transducer 53. Another DC motor 61 is suitably mounted in the stacker and is in drive relation with the shaft 56 and is also electrically connected with the transducer 53 through the wires 62, as shown. The motor 61 is suitably arranged, as is the electronic transducer 53, so that the electronic signals received by the transducer 53 from the two sensors 41 and 42 will be passed to the DC motor 61 to thus cause the motor 61 to be operated at a speed in accordance with the two signals received from the sensors 41 and 42. In turn, the stack drive shaft 56, and thus the conveyor 11, is operated at a speed corresponding to the signals received from the sensors 41 and 42. That is, if the thickness T of the stream SS were to increase, that would create a certain signal at the transducer 53 and that signal would be conveyed to the DC motor 61 to cause the motor 61 to run at a faster speed and thus accommodate the greater thicknesses or quantity of the incoming sheets so that the stack S could grow at a faster rate while the conveyor 11 moves at that faster rate. Likewise, if the printing press or the basic drive unit is running at a speed faster than some normal speed, again the generator 42 will sense that increase in speed and conduct a signal to the transducer 53 which in turn will conduct the signal to the driving DC motor 61 and thus drive the shaft 56 and therefore the conveyor 11 at a faster speed to accommodate the greater quantity of sheets coming into the stack S. Beyond the showing and word description given herein, the construction of the sensors 41 and 42, and their connected relationship with any of the parts shown herein, are conventional and will be understood by one skilled in the art who was therefore enabled to make a speed control construction of the type described herein. Likewise, the construction and characteristics of the transducer 53 are conventional and will be understood by one skilled in the art who was therefore enabled to make the arrangement by virtue of his prior knowledge and the disclosure herein.

It will be further seen and understood that the method for controlling a sheet stacker is described in the aforesaid teachings and disclosed in the drawings included herein, and thus the method of supporting the sheets in a stream relation on the first driven conveyor 10 is disclosed, and the electronic sensing of the thickness of the stream and the speed of the stream on the first conveyor 10 is apparent and the collecting of the stack of sheets on the second conveyor 11 is disclosed. Finally, the electric driving of the second driven conveyor, in accordance with the speed of the first driven conveyor and the thickness of the stream of the sheets on the first driven conveyor, is also disclosed, and the utilization of the transducer 53 is disclosed.

Further, the description herein discloses the second conveyor which is the conveyor 11 which has the driver mechanism 61 in the form of the DC motor described. With that arrangement, the second conveyor 11 is driven at a controlled speed, according to the two variables of the thickness T and the speed of the motor 57 which is driven from the main source of power, such as the printing press or the sheet folder or the like, not shown. Thus it will be seen and understood that there are two electronic inputs in lines 52 and two electronic inputs in line 59 for the transducer 53, however there is only one source of output in the lines 62. The transducer 53 integrates the inputs through 52 and 59, and, of course, if the sum of the integrated input signals is zero, then the output signal in lines 62 is zero and there is no change in stack driven speed. However, if the input signals show a net increase in the bulk of sheets entering the stack, then the output signal in 62 reflects this to increase the speed of conveyor 11, and conversely if the input signals through 52 and 59 show a net decrease in the transducer 53.

What is claimed is:

1. Apparatus for controlling sheet stacker speed for the collection of a stack of sheets, comprising a first conveyor for the movable support of a stream of sheets having a thickness, a second conveyor for the movable support and collection of a stack of sheets formed from the stream of sheets on said first conveyor, a driver mechanism operatively associated with said second conveyor for driving said second conveyor at a controlled speed, a first sensor member operatively associated with said first conveyor and the stream of sheets on said first conveyor for detecting change in the thickness of the stream of sheets, a second sensor member operatively associated with said first conveyor for detecting change in the speed of said first conveyor, a transducer connected with both said sensor members and sensitive to any change detected by said first sensor member in the thickness of the stream of sheets and sensitive to any change in the speed of said first conveyor, said transducer being connected with said driver mechanism for controlling said driver mechanism and thereby controlling the speed of said second conveyor.

2. The apparatus for controlling sheet stacker speed for the collection of a stack of sheets as claimed in claim 1, wherein said first conveyor includes a support against which the stream is pressed in going past said support, and said first sensor member being a thickness gauge.

3. The apparatus for controlling sheet stacker speed for the collection of a stack of sheets as claimed in claim 1 or 2, wherein said driver mechanism and said sensor members and said transducer all include electronic components and are all electrically connected together.

4. The apparatus for controlling sheet stacker speed for the collection of a stack of sheets as claimed in claim 2, wherein said support is a rotatably mounted drum around which the stream of sheets is guided, and said thickness gauge including a feeler yieldingly urged against the stream of sheets and toward said drum.

5. The apparatus for controlling sheet stacker speed for the collection of a stack of sheets as claimed in claim 4, wherein said driver mechanism and said sensor members and said transducer all include electronic components and are all electrically connected together, and said feeler is electronically connected and alters an electronic signal in accordance with the changes in the thickness of the stream of sheets.

6. The apparatus for controlling sheet stacker speed for the collection of a stack of sheets as claimed in claim 1, 4, or 5, wherein said driver mechanism and said sensor members and said transducer all include electronic components and are all electrically connected together, and said second sensor member includes a tachometer generator for producing an electronic signal in accordance with the changes in speed of said first conveyor.

7. The method of controlling sheet stacker speed, comprising the steps of supporting sheets in a stream relation on a first driven conveyor, electronically sensing the speed of said first conveyor and the thickness of the stream of sheets, collecting the stream of sheets into a stack supported on a second driven conveyor, and electrically driving said second driven conveyor in accordance with the speed of said first driven conveyor and the thickness of the stream of sheets.

8. The method of controlling sheet stacker speed as claimed in claim 7, communicating said electronic sensing from said transducer to an electronic transducer, and said second driven conveyor, thereby controlling the speed of said second driven conveyor.

* * * * *

UNITED STATES PATENT AND TRADEMARK OFFICE

CERTIFICATE OF CORRECTION

PATENT NO. : 4,361,318

DATED : 30 November 1982

INVENTOR(S) : Walter J. Stobb

It is certified that error appears in the above-identified patent and that said Letters Patent are hereby corrected as shown below:

In Claim 8, Column 6, Line 51, after "and" read -- communicating said electronic sensing from said transducer to --

In Claim 8, Column 6, Line 50 cancel "from said transducer"

Signed and Sealed this

*First* Day of *February 1983*

[SEAL]

*Attest:*

GERALD J. MOSSINGHOFF

*Attesting Officer*

*Commissioner of Patents and Trademarks*